United States Patent [19]

Ligda

[11] 4,050,205

[45] Sept. 27, 1977

[54] PROTECTIVE SHIELD FOR UTILITY OPENING IN A BUILDING FRAMING MEMBER

[76] Inventor: John P. Ligda, 53767 Kristin Court, Utica, Mich. 48087

[21] Appl. No.: 747,963

[22] Filed: Dec. 6, 1976

Related U.S. Application Data

[63] Continuation of Ser. No. 605,344, Aug. 18, 1975, abandoned.

[51] Int. Cl.[2] ..... E04C 3/16; E02D 35/00

[52] U.S. Cl. ..... 52/357; 52/514; 52/127; 174/48; 52/220

[58] Field of Search ..... 52/220, 127, 514, 173, 52/357, 359, 363, 362, 221; 174/48, 135

[56] References Cited

U.S. PATENT DOCUMENTS

| | | | |
|---|---|---|---|
| 3,211,824 | 10/1965 | Heiman | 52/220 |
| 3,211,825 | 10/1965 | Clos | 52/220 |
| 3,240,869 | 3/1966 | Jureit | 174/48 |
| 3,297,815 | 1/1967 | Drettman | 52/220 |
| 3,350,501 | 10/1967 | Jureit | 174/48 |
| 3,553,346 | 1/1971 | Ballantyne | 174/48 |
| 3,689,681 | 9/1972 | Searer et al. | 174/48 |

FOREIGN PATENT DOCUMENTS

| | | | |
|---|---|---|---|
| 394,173 | 6/1933 | United Kingdom | 52/357 |

*Primary Examiner*—Ernest R. Purser
*Assistant Examiner*—Robert C. Farber

[57] ABSTRACT

A protective shield overlies the wall panel supporting face of a building framing member and prevents a wall panel fastener of the self-drilling type from entering a utility service opening provided in the framing member. The protective shield is formed of a material and thickness which provides substantially greater resistance to penetration by the self-drilling fastener than the resistance of the wall panel supporting face of the framing member so that the fastener fails or the presence of the protective shield is sensed by the construction mechanic prior to entry of the fastener into the framing member. The protective shield includes integral fastening clips which project generally perpendicularly from the opposed side edges thereof and are adapted for resilient clamping engagement on the building framing member to mount the protective shield in juxtaposed relation with the face of the building framing member and in overlying alignment with the utility service opening. The integral fastener clips on one side of the protective shield have inwardly bent teeth formed thereon to grip the building framing member. An outwardly bent lip is provided on the fastening clips at the other side edge of the protective shield to provide a resilient outward camming of the integral fastening clips as the protective shield is attached to the framing member.

10 Claims, 6 Drawing Figures

PROTECTIVE SHIELD FOR UTILITY OPENING IN A BUILDING FRAMING MEMBER

This is a continuation, of application Ser. No. 605,344 filed Aug. 18, 1975 now abandoned.

BACKGROUND OF THE INVENTION

The invention relates to building construction systems and more particulary a protective shield for preventing a wall panel fastener from entering a utility service opening in a metallic wall stud.

Modern building construction systems commonly utilize metal framing members. For example, a typical wall stud is of roll-formed sheet steel and has a c-shaped or channel cross-section including a pair of legs which are connected in spaced apart relation by an integral web. The legs of the wall stud define wall panel supporting faces to which wall panels are fastened in spaced apart relation to define a space which may accommodate thermal and noise insulation and utility services such as piping or electrical wires. In order to permit routing of these utility services between the wall panels, it is known to provide a utility service opening in the web of the wall stud. The wall panels are typically attached to the face of the wall stud by self-drilling type screws which have an integral drill point on the tip which will penetrate first the wall panel and then the sheet steel of the leg of the wall stud.

A disadvantage of the aforedescribed building construction system is that a self-drilling screw which has the capability of penetrating the wall panel and the sheet steel leg of the wall stud is also capable of penetrating a utility service such as piping or electrical wires. When the wall panel is juxtaposed to the wall panel supporting face provided by the leg of the wall stud, the presence of utility service is of course concealed from view so that the construction mechanic may be chance insert a self-drilling screw in alignment with the utility service opening. It is accordingly not uncommon for piping or wiring to be penetrated by the self-drilling screw. Such penetration of the utility service poses a threat to the safety of the construction mechanic as well as rendering the utility service defective and necessitating costly removal of the wall panel and repair or replacement of the utility service.

SUMMARY OF THE INVENTION

It is accordingly an object of the invention to provide a protective shield which will prevent entry of a self-drilling fastener into a utility service opening in a metalic building framing member.

Another object of the invention is to provide a protective shield adapted to overlie the wall panel supporting face of the building framing member and having a body portion in alignment with a utility service opening which provides substantial resistance to penetration by a self-drilling fastener.

A still further object of the invention is to provide a protective shield having integral clips at the side edges thereof for resilient clamping engagement on the framing member.

According to the invention a protective shield is provided to overlie the wall panel supporting face of a building framing member and prevent a wall panel fastener of the self-drilling type from entering a utility service opening provided in the framing member. A body portion of the protective shield has opposed side edges which define a width sufficient to overlie substantially the full width of the wall panel supporting face of the framing member. Upper and lower edges of the body portion define a length sufficient to overlie substantially the full height of the utility service opening. Integral fastening clips project generally perpendicularly from the opposed side edges of the body portion. The fastening clips are adapted for resilient clamping engagement on the building framing member to mount the body portion in juxtaposed relation with the face of the building framing member and in overlying alignment with the utility service opening. The protective shield is formed of a material and thickness which provides substantially greater resistance to penetration by the self-drilling fastener than the resistance of the wall panel supporting face of the framing member so that the presence of the protective shield is sensed by the construction mechanic or the self-drilling fastener fails prior to its entry into the utility service opening. The integral fastener clips includes a pair of clips at one side edge of the body portion having inwardly bent teeth formed thereon to grip the framing member and prevent movement of the protective shield on the framing member. A pair of clips at the other side edge of the body portion have an outwardly bent lip which provides a resilient outward camming of the clips as the protective shield is attached to the framing member.

BRIEF DESCRIPTION OF THE DRAWINGS

These and other objects, advantages, and features of the invention will become apparent upon consideration of the specification and the appended drawings in which.

DETAILED DESCRIPTION OF THE PREFERRED EMBODIMENT

Figure 1:
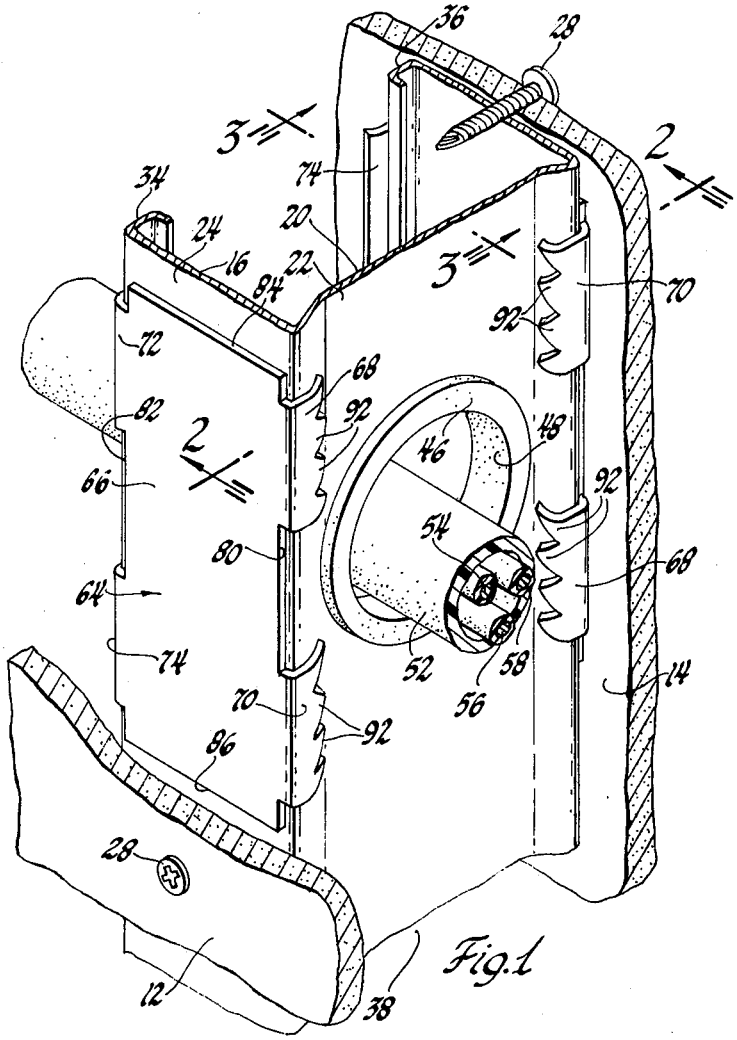
FIG. 1 is a perspective view having parts broken away and in section.
Figure 3:
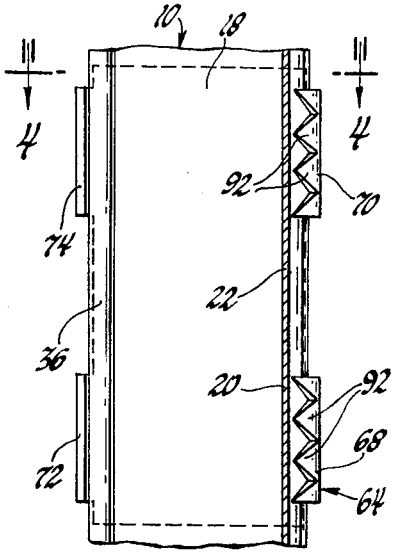
FIG. 3 is a sectional view taken in the direction of arrows 3—3 of FIG. 1.

Referring to FIG. 1 of the drawings it will be seen that a typical building construction system includes a framing member or wall stud generally indicated at 10 and wall panels 12 and 14. The wall stud 10 is constructed of roll-formed sheet steel and has a C-shaped or channel configuration including spaced apart legs 16 and 18 which are connected by an integral connecting web 20. The legs 16 and 18 provide spaced-apart wall panel supporting faces 24 and 26 to which the wall panels 12 and 14 are attached by self-drilling screws 28 having a self-drilling and tapping tip which will penetrate both the wall panel and the juxtaposed leg of the wall stud 10 when it is driven by a power screwdriver. Reversely bent flange structures 34 and 36 are provided respectively at the ends of the legs 16 and 18.

Figure 4:
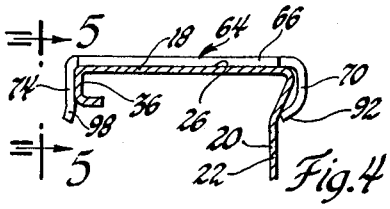
FIG. 4 is a sectional view taken in the direction of arrows 4—4 of FIG. 3.
Figure 5:
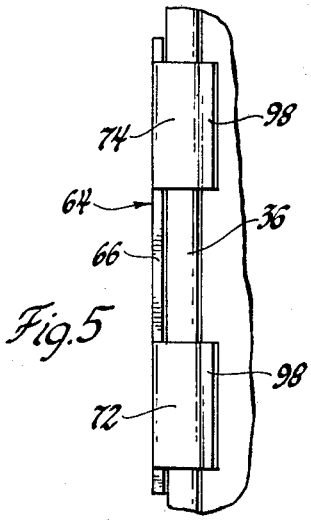
FIG. 5 is partial elevation view taken in the direction of arrows 5—5 of FIG. 4.
Figure 2:
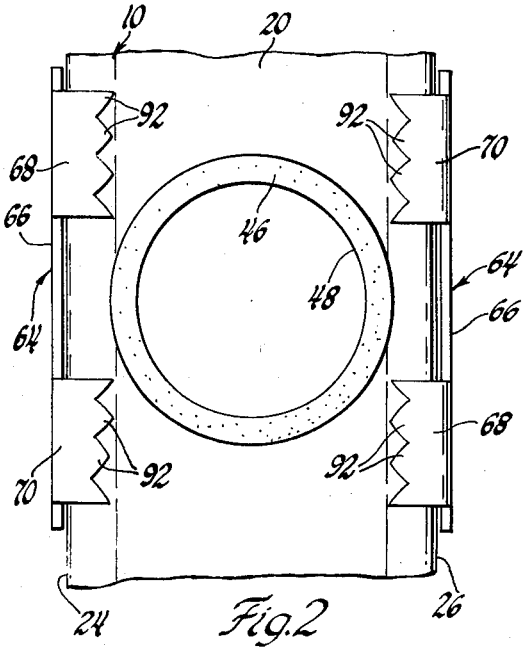
FIG. 2 is a view taken in the direction of arrows 2—2 of FIG. 1.

Referring to FIGS. 1 and 4 it will be seen that the web 20 of the wall stud 10 has its central portion bowed inwardly or recessed somewhat from the ends of the legs 16 and 18. It will be understood that the wall stud 10 shown in the drawings is only one example of the commercially available wall studs and that the protective shield of this invention may be utilized in combination with wall studs of various configuration and size. Furthermore, in some building construction systems the self-drilling fastener does not directly penetrate the wall panel itself but the edges of adjacent wall panels are received in a connecting element or bracket which is in turn attached to the wall stud by the self-drilling fastener.

The presence of the wall studs 10 between the wall panels 12 and 14 defines a space 38 therebetween which accommodates thermal and noise insulation as well as utility services such as piping and wiring. An aperture is provided in the web 20 of the wall stud 10 and preferably receives a plastic sleeve 46 to define a utility service opening 48 so that the utility services can be routed through the wall stud 10 and between the wall panels 12 and 14. The utility service opening 48 through the web 20 communicates with the hollow space 50 defined between the legs 16 and 18 and the web 20 of the wall stud 10 so as to connect the wall spaces 38 on both sides of the wall stud 10.

A typical utility service, as seen in FIG. 1, includes an electrical conduit 52 which extends between the wall panels 12 and 14 and through wall stud 10 via the utility service opening 48 and hollow space 50. Insulated electrical wires 54, 56, and 58 are provided in the conduit 52. As best seen in FIG. 1, the presence of the wall panels 12 and 14 over the wall panel supporting faces 24 and 26 of wall stud 10 conceals the conduit 52 from the view of the construction mechanic. Accordingly, when the self-drilling screws 28 are utilized to attach the wall panel 12 to the leg 16 of the wall stud 10, it is possible for a self-drilling drilling screw 28 to be inserted through the wall panel 12 and leg 16 of the wall stud 10 in direct alignment with the conduit 52. This presents the possibility that the self-drilling screw 28 will penetrate the conduit 52 and damage the electrical wires 54, 56, and 58.

Figure 6:
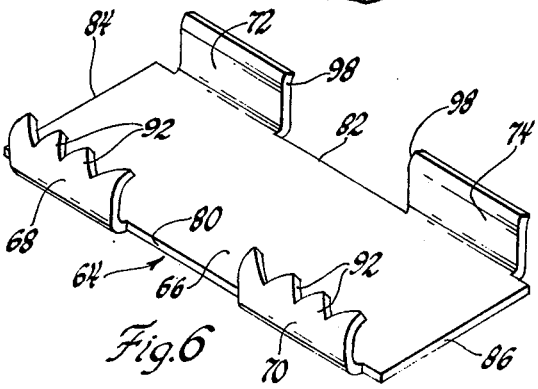
FIG. 6 is a perspective view of the protective shield for the invention.

A protective shield, generally indicated at 64, is provided to prevent a self-drilling screw 28 from piercing the leg of the wall stud in alignment with the utility service opening 48. As best seen in FIGS. 1 and 6, the protective shield 64 is a sheet metal stamping including a body portion 66, and integral fastening clips 68, 70, 72, and 74 by which the protective shield is clampingly engaged on the wall stud 10 with the body portion 66 thereof overlying the wall panel supporting face 24 of the leg 16. The sheet metal or steel from which the protective shield 64 is stamped is of a thickness and hardness which provides a substantial resistance to penetration by the self-drilling screw 28. This resistance of the protective shield 64 must be greater than the resistance to penetration by the wall panel 12 or the leg 16 of the wall stud 10. The resistance of the protective shield 64 to penetration by the self-drilling screw 28 may be sufficient to cause failure by dulling or fracture of the self-drilling tip of the screw 28 prior to penetration of the shield. In the alternative, the protective shield may have a penetrative resistance of a sufficient level to be sensed by the construction mechanic so that the mechanic may terminate insertion of the self-drilling screw before the self-drilling screw 28 penetrates the body portion 66 of the protective shield. One skilled in the art will appreciate that the thickness, the hardness, and other design factors may be varied to provide the desired penetrative resistance in the body portion 66 of the protective shield 64.

As seen in FIG. 1, the body portion 66 is generally planar so that it closely follows the contour of the wall panel supporting face 24 so as to minimize distortion of the wall panel 14 by the presence of the protective shield between the wall panel 12 and the wall stud 10. The body portion 66 has opposed side edges 80 and 82 which define a width of the body portion 66 which is sufficient to overlie substantially the full width of the wall panel supporting face 24 of the wall stud 10. The body portion 66 also has an upper edge 84 and a lower edge 86 which define a length sufficient to overlie substantially the full vertical extent of the utility service opening 48. Preferably, as seen in FIG. 1, the length of the body portion 66 is sufficient to extend even beyond the full extent of the utility service opening 48 to assure that the self-drilling screw 28 cannot reach the conduit 52 even when the conduit 52 is not centered in the utility service opening 48, or when the protective shield 64 is not mounted in optimum alignment with the conduit 52, or even when the self-drilling screw 28 is applied at somewhat of an angle from the horizontal. I have found that a length of about three inches is acceptable.

As best seen in FIGS. 4 and 6, the fastening clips 68 and 70 extends generally perpendicularly from the body portion 66 at the side edge 80 thereof and are notched at their ends to provide a plurality of teeth 92 on both of the fastening clips 68 and 70. As best seen in FIG. 4, these teeth 92 of the fastening clips 68 and 70 are bent inwardly somewhat so as to grippingly engage the web 20 of the wall stud 10, irrespective of some slight degree of variation in the shape of the web 20.

As best seen in FIGS. 4 and 6, the fastening clips 72 and 74 have an outwardly bent lip configuration 98 at their ends. The outwardly bent lips 98 on the fastening clips 72 and 74 facilitate attachment of the protective shield 64 by providing a resilient outward camming action of the integral fastening clips.

The protective shield 64 is best attached to the wall stud 10 by first engaging the teeth 92 of the fastening clips 68 and 70 over the web 20 and then forcing the clips 72 and 74 over the flanged end 34 or 36 of the respective leg of the wall stud 10. As the fastening clips 72 and 74 are forced over the flanged end of the leg of the wall stud 10, the outwardly bent lips 98 thereof provide a resilient outward camming action which spreads the opposed fastening clips apart. The fastening clips 68, 70, 72, and 74 provide a resilient clamping engagement which attaches the protective shield 64 to the leg of the wall stud 10 with the body portion 66 in overlying engagement of the wall panel supporting face 24 and in alignment with the utility service opening 48.

It will be appreciated by a person skilled in the art that the dimensional extent of the body portion 66 and the fastening clips 68, 70, 72, and 74 may be varied somewhat to fit the many and various sizes and shapes of wall studs which are commercially available.

Thus, the invention provides an improved and useful protective shield for preventing a self-drilling wall panel fastener from entering a utility service opening in a metallic building framing member.

What is claimed is:

1. A protective shield adapted to overlie the wall panel supporting face of a building framing member and prevent a wall panel fastener of the self-drilling type from entering a utility service opening provided in the framing member, said protective shield comprising: a generally planar body portion having opposed side edges defining a width sufficient to overlie substantially the full width of the wall panel supporting face of the framing member and upper and lower edges defining a length sufficient to overlie substantially the full extent of the utility service opening, and fastening clips means integral with the body portion and projecting generally perpendicularly from the opposed side edges thereof, said fastening clips being adapted for outward camming action during forced installation of the protective shield over the face of the framing member and adapted for resilient clamping engagement on the building framing member to attach the body portion in juxtaposed relation with the wall panel supporting face of the building framing member and in overlying alignment with the utility service opening, said body portion being of material and thickness effective to provide resistance to penetration by the self-drilling type fastener which is greater than the resistance to penetration of the wall panel supporting face of the framing member whereby the presence of the protective shield is sensed and insertion of the self-drilling fastener is terminated prior to entry of the self-drilling fastener into the utility service opening.

2. The protective shield of claim 1 further characterized by the body portion having a resistance to penetration which exceeds the self-drilling capability of the self-drilling fastener so that the fastener cannot penetrate the protective shield and is thereby prevented from entering the utility service opening.

3. The protective shield of claim 1 wherein the integral fastening clip means at one of the side edge of the body portion has inwardly bent teeth formed thereon for gripping engagement of the framing member.

4. The protective shield of claim 3 wherein the teeth formed on the integral fastening clip means at the one side edge of the body portion are inwardly bent and the opposing integral fastening clip means at the other side edge of the body portion has an outwardly bent lip providing a resilient outward camming of th integral fastening clip means as the protective shield is attached to the framing member.

5. The protective shield of claim 2 wherein the integral fastening clip means at one of the side edge of the body portion has inwardly bent teeth formed thereon for gripping engagement of the framing member to prevent the protective shield from moving on the framing member.

6. The protective shield of claim 5 wherein the teeth formed on the integral fastening clip means at the one side edge of the body portion are inwardly bent and the opposed integral fastening clip means at the other side edge of the body portion has an outwardly bent lip providing a resilient outward camming of the integral fastening clip means as the protective shield is attached to the framing member.

7. A protective shield adapted to overlie one of the wall panel supporting legs of a framing member having a pair of wall panel supporting legs spaced apart by an integral connecting web having a utility service opening therein to prevent a wall panel fastener from entering the utility service opening, said protective shield having a generally planar body portion having opposed side edges defining a width sufficient to overlie substantially the full width of the wall panel supporting leg of the framing member and upper and lower edges defining a length sufficient to overlie substantially the full extent of the utility service opening, said body portion being of material and thickness effective to provide resistance to penetration by the wall panel fastener which is greater than the resistance to penetration of the wall panel supporting leg of the framing member, and fastening clip means integral with the body portion and projecting generally perpendicularly therefrom for non-piercing clamping engagement with the framing member to mount the body portion in juxtaposed overlying relation with the wall panel supporting leg, the integral fastening clip means at one of the side edges of the body portion extending closely adjacent the web extending between the wall panel supporting legs and having inwardly bent teeth formed thereon for extending into gripping engagement with the web extending between the wall panel supporting legs, the integral fastening clip means at the other side edge of the body portion having an outwardly bent lip providing a resilient outward camming of the integral fastening clip means as the protective shield is engaged over the wall panel supporting leg.

8. In combination, a wall structure having a sheet metal framing member with vertically extending wall panels supporting legs positioned in spaced apart relation by a connecting web integral with the legs and having a utility opening therein, a protective shield adapted to overlie the wall panel supporting leg and prevent a wall panel fastener of the self-drilling type from entering the utility opening, said protective shield having a generally planar body portion having opposed side edges defining a width sufficient to overlie substantially the full width of the wall panel supporting leg of the framing member and upper and lower edges defining a length suufficient to overlie substantially the full extent of the utility service opening, fastening clip means integral with the body portion and projecting generally perpendicularly from the opposed side edge thereof, the integral fastening clip means at one of the side edges of the body portion having inwardly bent teeth formed thereon for gripping engagement of the edge portion of the wall panel supporting leg, the integral fastening clip means at the other side edge of the body portion having an outwardly bent lip providing a resilient outward camming of the integral fastening clip means as the protective shield is engaged over the wall panel supporting leg, said body portion being of material and thickness effective to provide resistance to penetration by the self-drilling type fasteners which is greater than the resistance to penetration of the wall panel supporting leg of the framing member, the protective shield being mounted on the wall panel supporting leg of the wall stud with the body portion in juxtaposed overlying relation with the wall panel supporting leg so that the wall panel supporting leg supports the body portion over substantially the entire surface thereof so that the body portion is supported against bending during application of force thereagainst by insertion of the self-drilling type fastener.

9. In combination, a wall structure having a C-shaped metal framing member with vertically extending wall panel supporting legs spaced apart by an integral web having a utility opening therein and connecting the edge portion of one leg with the edge portion of the other leg, a protective shield adapted to overlie one of the wall panel supporting legs and prevent a wall panel fastener of the self-drilling type from entering the utility opening, said protective shield having a generally planar body portion having opposed side edges defining a width sufficient to overlie substantially the full width of the wall panel supporting leg of the framing member and upper and lower edges defining a length sufficient to overlie substantially the full extent of the utility service opening, fastening clip means integral with the body portion and projecting generally perpendicularly from the opposed side edges thereof, the integral fastening clip means at one of the side edges of the body portion having inwardly bent teeth formed thereon for extending around the edge portion of the wall panel supporting face and into gripping engagement with the web extending between the edge portions of the wall panel supporting legs to prevent the shield from slipping on the wall panel supporting leg, clip means at the other side edge of the body portion having an outwardly bent lip providing a resilient outward camming of the integral fastening clip means as the protective shield is engaged over the wall panel supporting leg, said body portion being of material and thickness effective to provide resistance to penetration of the wall panel supporting leg by the self-drilling fastener, the protective shield being mounted on the wall panel supporting leg of the framing member with the body portion in juxataposed overlying relation with the wall panel supporting leg so that the wall panel supporting leg supports the body portion over substantially the entire surface thereof so that the body portion is supported against bending during application of force thereagainst by insertion of the self-drilling fastener.

10. A protective shield adapted to overlie the wall panel supporting face of a building framing member and prevent a wall panel fastener of the self-drilling type from entering a utility service opening provided in the framing member, said protective shield comprising: a generally planar body portion having opposed side edges defining a width sufficient to overlie substantially the full width of the wall panel supporting face of the framing member and upper and lower edges defining a length sufficient to overlie substantially the full extent of the utility service opening, and fastening clip means integral with the body portion and projecting generally perpendicularly from the opposed side edges thereof, the integral fastening clip means at one of the side edges of the body portion having inwardly bent teeth formed thereon for gripping engagement of the framing member and the opposing integral fastening clip means at the other side edge of the body portion having an outwardly bent lip providing a resilient outward camming of the integral fastening clip means as the protective shield is engaged on the wall panel supporting face of the framing member, said fastening clip means resiliently clamping the protective shield on the building framing member to mount the body portion in juxtaposed relation with the wall panel supporting face of the building framing member and in overlying alignment with the utility service opening, said body portion being of material and thickness effective to provide resistance to penetration by the self-drilling type fastener which is greater than the resistance to penetration of the wall panel supporting face of the framing member whereby the presence of the protective shield is sensed and insertion of the self-drilling fastener is terminated prior to entry of the self-drilling fastener into the utility service opening.

* * * * *